United States Patent [19]

Tanaka

[11] 4,087,888

[45] May 9, 1978

[54] METHOD AND APPARATUS FOR REMOVING WASTE SETTLING UNDER CARDING MACHINE OR THE LIKE

[75] Inventor: Toyozo Tanaka, Takada, Japan

[73] Assignee: Unitika Limited, Japan

[21] Appl. No.: 591,053

[22] Filed: Jun. 27, 1975

[30] Foreign Application Priority Data

| | | |
|---|---|---|
| Jun. 29, 1974 | Japan | 49/74808 |
| Jul. 1, 1974 | Japan | 49/75116 |
| Jul. 1, 1974 | Japan | 49/75118 |
| Dec. 16, 1974 | Japan | 49/144264 |
| Dec. 16, 1974 | Japan | 49/144265 |
| Feb. 28, 1975 | Japan | 50/25494 |
| Feb. 28, 1975 | Japan | 50/25495 |

[51] Int. Cl.[2] ..... D01G 15/82

[52] U.S. Cl. ..... 19/107; 15/301

[58] Field of Search ..... 19/107; 209/135; 15/301, 306 R

[56] References Cited

U.S. PATENT DOCUMENTS

| | | | |
|---|---|---|---|
| 1,054,183 | 2/1913 | Davis | 209/135 |
| 1,087,882 | 2/1914 | Lamb | 15/301 X |
| 2,964,804 | 12/1960 | Schnonenberger | 19/107 |

FOREIGN PATENT DOCUMENTS

| | | | |
|---|---|---|---|
| 412,659 | 11/1966 | Switzerland | 19/107 |
| 910 of | 1853 | United Kingdom | 19/107 |
| 565,905 | 12/1944 | United Kingdom | 19/107 |
| 1,085,119 | 9/1967 | United Kingdom | 19/107 |
| 1,138,220 | 12/1968 | United Kingdom | 19/107 |
| 971,830 | 10/1964 | United Kingdom | 19/107 |
| 1,082,628 | 9/1967 | United Kingdom | 19/107 |
| 1,126,254 | 9/1968 | United Kingdom | 19/107 |
| 350,878 | 1/1971 | U.S.S.R. | 19/107 |

*Primary Examiner*—Dorsey Newton
*Attorney, Agent, or Firm*—Joseph W. Farley

[57] ABSTRACT

Waste from a textile machine is removed by providing an air channel having top, side and bottom walls. In the area where the waste settles, the top wall of the air channel is formed by one or more shutters movable between closed and opened positions. When the shutters are opened, waste which has accumulated thereon when closed or which comes directly from the machine, falls into the air channel. The shutters are then closed and an air current is produced in the air channel by suitable means to convey the waste away.

11 Claims, 24 Drawing Figures

Fig. 3-A
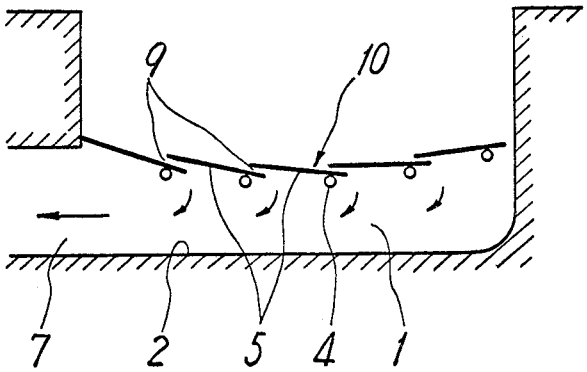
Fig. 3B
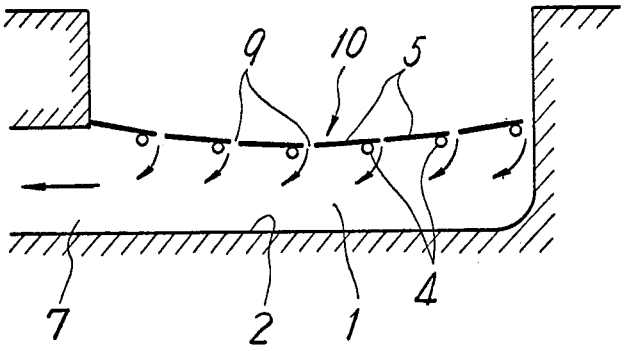

METHOD AND APPARATUS FOR REMOVING WASTE SETTLING UNDER CARDING MACHINE OR THE LIKE

The present invention relates to a method and apparatus for removing waste settling on an area under and substantially under a machine, for example, waste including fly, trash and yarn fragments settling on an area under and substantially under a picker or scutcher, a flyer frame, a spinning frame, a winder, a twister, a reeling machine, a loom or other machines in a textile mill.

Heretofore, it has been a usual practice to employ an air nozzle to blow off waste settling under a machine to a different area on the floor and sweep it together for removal, or employ a broom or a brush with a long stick to sweep it away direct from the area where it has first settled.

Such conventional methods, especially the former, have the disadvantage that since waste including trash is scattered, not only are environmental and hygienic conditions adversely affected, but also much time and labor will be involved in sweeping the scattered particles together. As for the latter method, it, of course, needs much time and labor, and besides, it can be applied only when there is a sufficient space under a machine to permit the operation to be carried out.

In order to eliminate these disadvantages, there may be conceived a method in which a space under a machine is enclosed and the air is then sucked from said space to thereby draw the waste to a predetermined location. To take a carding machine as an example, however, the space under the taker-in roller, cylinder and doffer is relatively large and communicates with the ambient space, which means that a suction means which is powerful and large in size has to be used in order to produce a sufficiently strong current of air to draw the waste from under these constituent members. Thus, such method is not practical. Moreover, since the suction force will also act on the lap or material on the carding machine, there is the danger of sucking away even good fibers in large quantities from adjacent the taker-in roller. This inhibits the removal of waste from being carried out during operation of the carding machine.

As a method intended to eliminate these drawbacks, it has been put into practice to install a rotary conveyor belt under a machine to automatically remove waste, but this method can be applied only when the under-machine space has sufficient vastness and contour to permit installation of such bulky equipment called a rotary conveyor. There are other disadvantages in this method including the conveyor belt tending to be locally stretched, foreign matter being entwined around the rotary shaft or sticking to the inner side of the belt to interfere with smooth rotation of the belt or even damage the latter.

The present invention provides a method and apparatus which are capable of satisfactorily solving the above described problems inherent in the conventional methods.

According to the present invention, an air channel having its bottom and opposite sides closed is disposed in a location where waste settles, said air channel being provided with shutter means adapted to be switched between an erected position where it permits entry of waste into said air channel and a prostrated position where it cuts off communication between the inside and outside of said air channel, so that said shutter means is opened when it is desired to permit waste to fall into said air channel, but when it is desired to pneumatically convey and discharge the waste in said air channel by waste discharging air currents flowing in said air channel, said shutter means is closed to cut off communication between the inside and outside of said air channel, enabling the waste to be securely and automatically discharged by a small amount of air current.

According to the present invention, even if a blow air current is employed to convey and discharge waste, the shutter means which will close the top of the air channel during discharge operation prevents the blow air current from influencing the outside environment above the air channel. Thus, the present invention eliminates the drawbacks of the conventional waste blow-cleaning method including the danger of blowing off waste including trash to other areas than the intended area.

Further, in the case of drawing and discharging waste by suction air current, since the region to which suction is to be directed is an enclosed narrow duct-like space, a small amount of air current suffices for reliable removal of waste, there being no need to direct suction to other regions than the air channel. Thus, the present invention also eliminates the drawbacks of the conventional waste suction-cleaning method.

Further, as compared with a rotary conveyor belt, the apparatus according to the present invention is easy to install and inexpensive, and besides, it seldom gets out of order and is easy of maintenance.

The present invention comprises two types of methods, one in which said shutter means is left open except in waste removal operation time so as to permit waste to fall direct into the air channel and settle there, the other in which the shutter means is kept closed even when waste removal operation is not taking place, so as to permit waste to once settle on said shutter means, and at a predetermined time it is temporarily opened to permit the accumulated waste to fall into the air channel. As compared with the former method in which waste which has been accumulated in time is pneumatically conveyed in its accumulated condition, the latter method has the merit of being capable of pneumatically conveying waste with ease even in the case of discharging it by suction air current since the waste, when permitted to fall into the air channel, is agitated into an expanded soft state.

Other numerous features and merits of the present invention will be readily understood from the following description of preferred embodiments of the invention to be given with reference to the accompanying drawings, in which.

Figure 4:
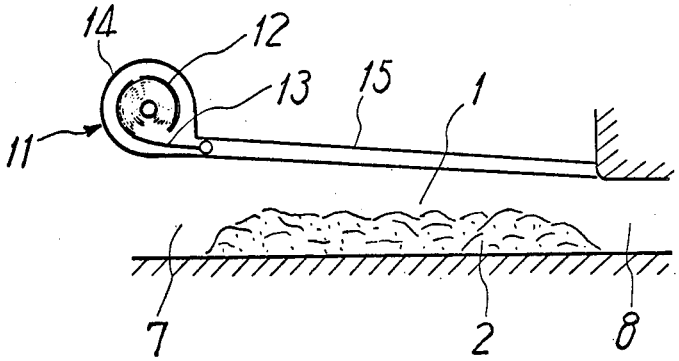
Figure 5:
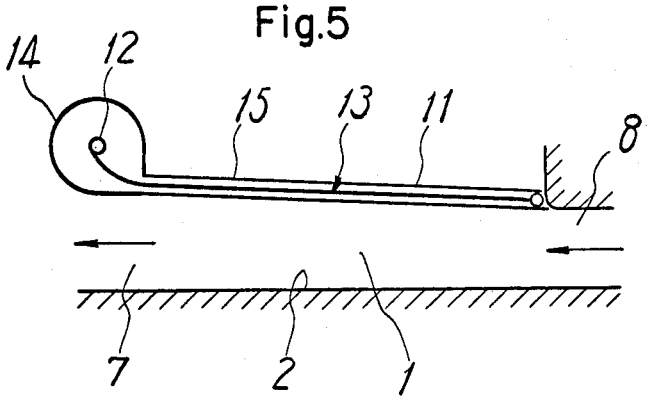
Figure 6:
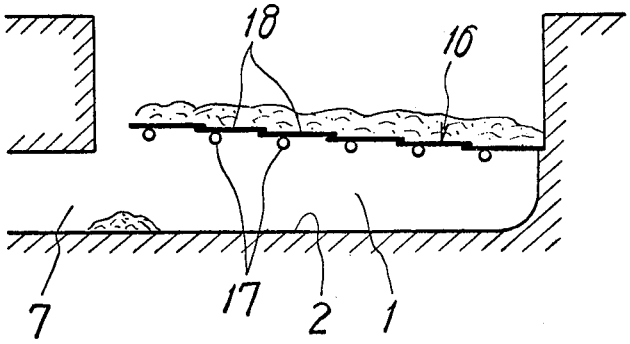
Figure 7:
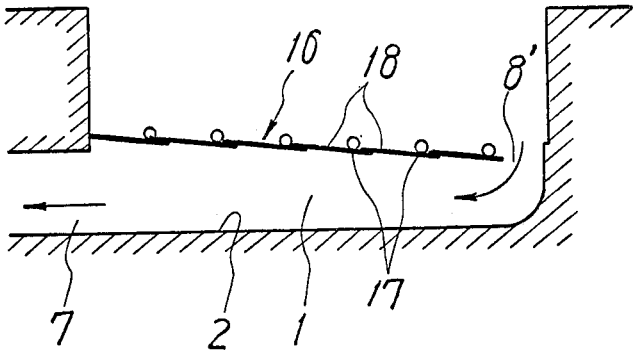
Figure 8:
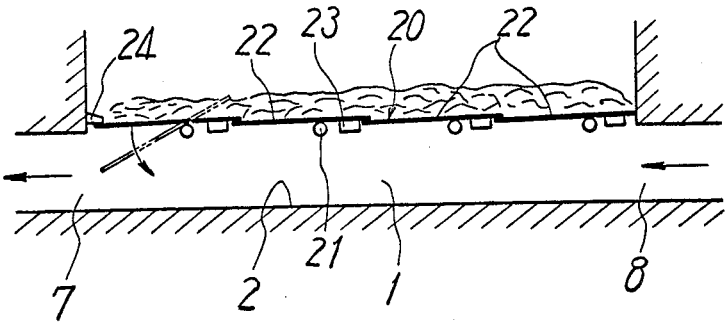
Figure 9:
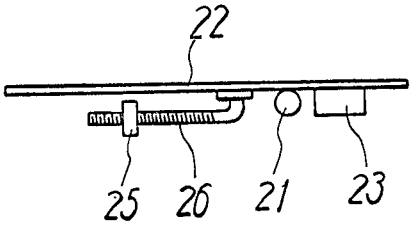
Figure 10:
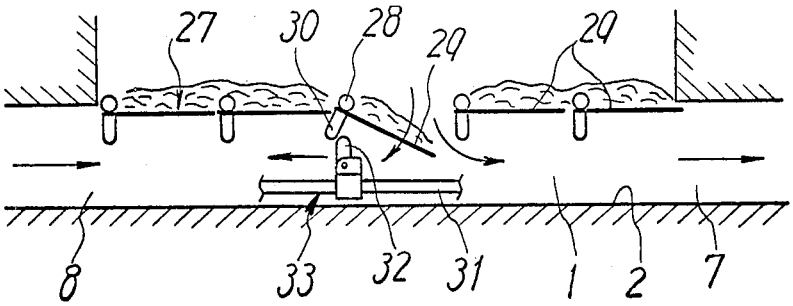
Figure 11:
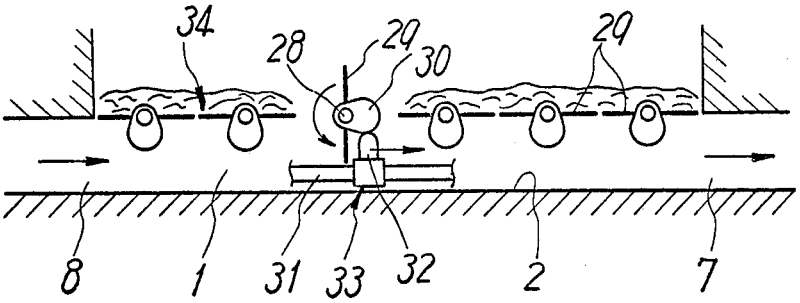
Figure 12:
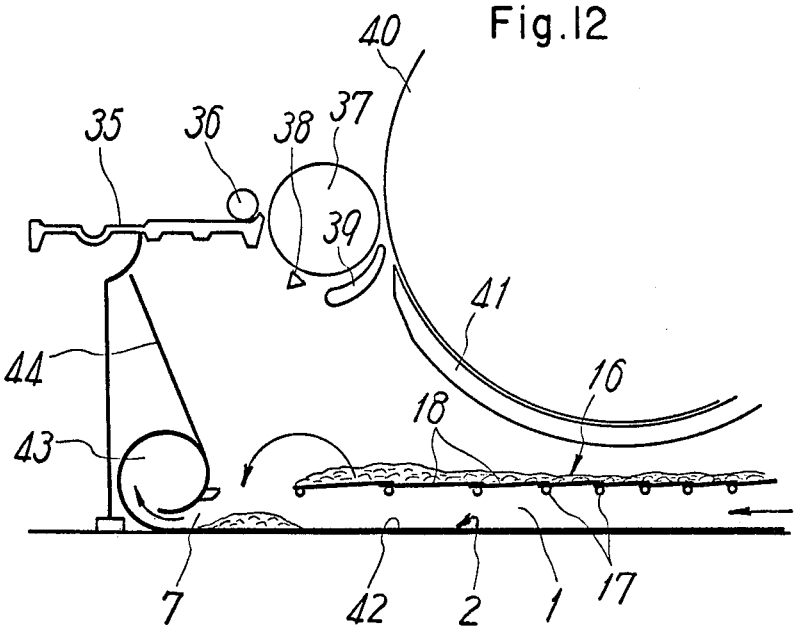
Figure 13:
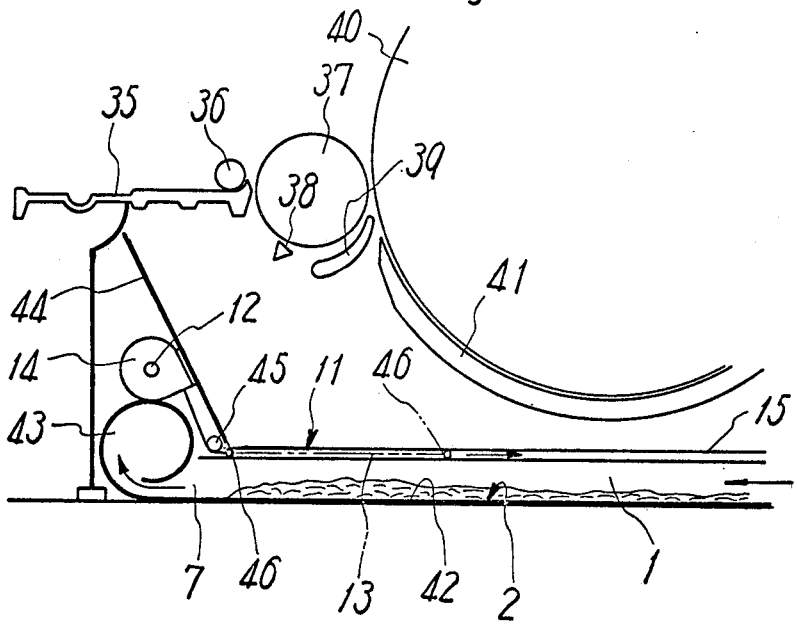
Figure 14:
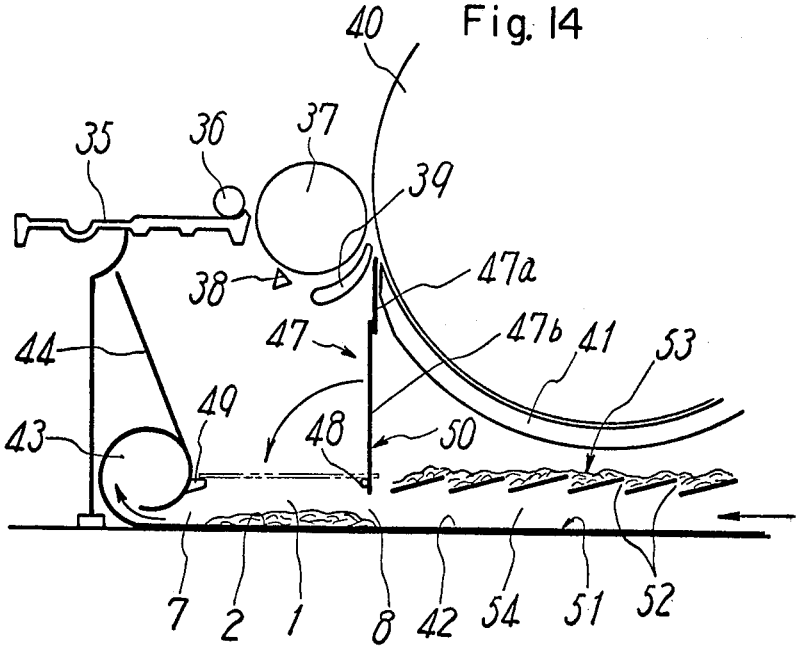
Figure 15A:
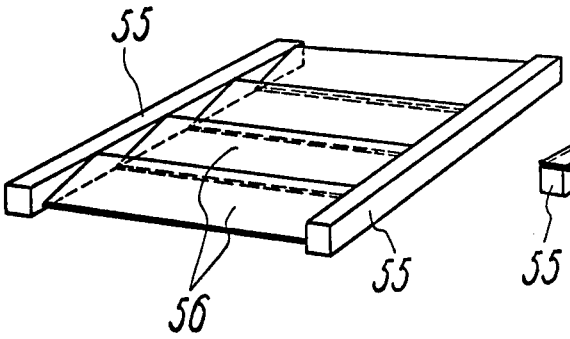
Figure 15B:
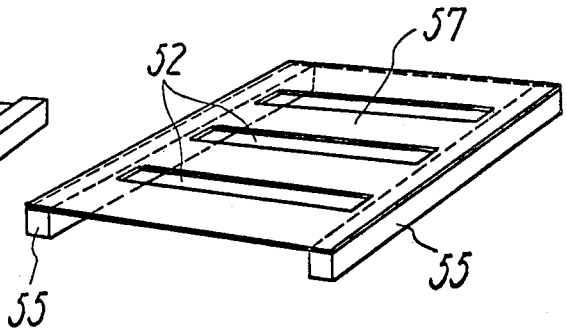
Figure 16:
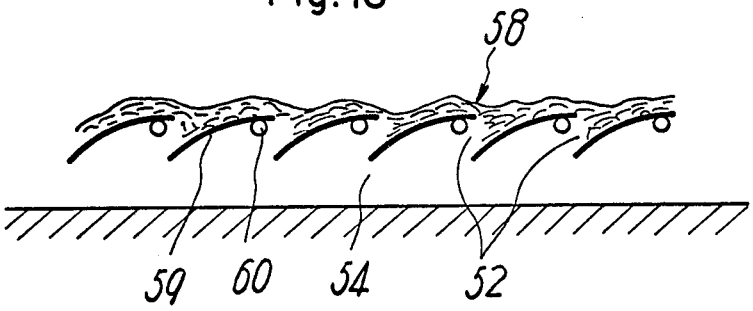
Figure 17:
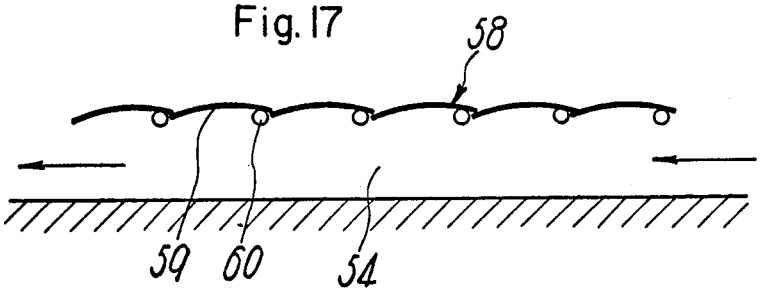

FIGS. 3 A and B are elevational views in longitudinal section, showing a manner in which air is sucked through clearances in the shutter means;

FIGS. 4 and 6 are elevational views in longitudinal section of different shutter means;

FIGS. 5 and 7 are elevational views in longitudinal section; showing the conditions of waste removal operation in the arrangements shown in FIGS. 4 and 6, respectively;

FIG. 8 is an elevational view in longitudinal section of self-openable and closeable type shutter means;

FIG. 9 is a side view showing the essential portion of an improved form of the shutter shown in FIG. 8;

FIGS. 10 and 11 are elevational views, partly broken away, of shutter means each provided with a device for successively opening the shutter members;

FIGS. 12 through 14 are elevational views in longitudinal section, showing the essential portion of the present inventive apparatus as applied to a carding machine;

FIGS. 15 A and B are enlarged perspective views of grids such as the one shown in FIG. 14;

FIG. 15 is an elevational view showing an improved form of such grid;

FIG. 17 is an elevational view of the essential portion showing the grid shown in FIG. 16, in closed position, and FIGS. 18 through 22 are elevational views in longitudinal section of a carding machine in its entirety, showing different embodiments of the present invention.

Figure 1:
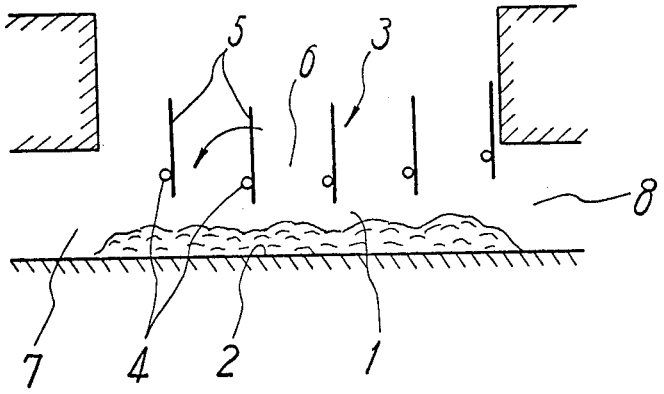
FIG. 1 is an elevational view in longitudinal section illustrating the principle of the present invention.
Figure 2:
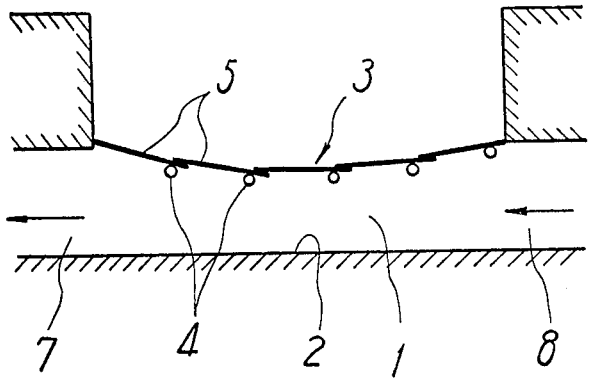
FIG. 2 is an elevational view in longitudinal section showing the shutter means in FIG. 1 in its prostrated position.

Referring to FIGS. 1 and 2, designated at 1 is an air channel having its bottom 2 and opposite sides (not shown) closed, said air channel being disposed in an under-machine or other location where waste settles. The top of said air channel 1 is provided with shutter means 3 adapted to be switched between an open position where it permits waste to enter the air channel 1 and a closed position where it cuts off communication between the inside and outside of the air channel, said shutter means comprising plate-like shutter members 5 suitably spaced apart from each other lengthwise of the air channel 1 and rotatable with their respective rotary operating shafts 4 between a first or erected position (see FIG. 1) and a second or prostrated position (see FIG. 2). In the erected position shown in FIG. 1, the plate-like shutter members 5 define a waste fall passageway 6 between adjacent shutter members 5, whereas in the prostrated position shown in FIG. 2, they overlap each other along their adjacent ends (or they may approach each other rather than overlapping) so as to form a continuous top cover for the air channel.

It is not absolutely necessary to constitute the entire shutter means 3 by such movable shutter members 5. For example, a fixed bar may be interposed between adjacent shutter members 5. In that case, if a wide bar is used as such fixed bar, the upper surface of the bar may be unilaterally or bilaterally sloped so as to make it difficult for waste to settle thereon. Further, the sectional shape (or longitudinal section normal to the direction of flow of air current) of the air channel 3 defined when its top is closed with the shutter means 3 is not limited to rectangle and it may have any desired shape, e.g., one having an arcuate bottom. Further, the shutter members 5 may have the axes of their shafts directed parallel to the direction of flow of air current in the air channel 1.

With the shutter members 5 held in the first or erected position as shown in FIG. 1, the waste falling from the machine, swept up or blown together passes through the passageways 6 between the shutter members 5 to settle on the bottom 2 of the air channel 1. When it accumulates to a certain degree, the shutter members 5 are rotated by the rotary operating shafts 4 to assume the second or prostrated position shown in FIG. 2, thereby closing the top of the air channel 1. And, a waste discharging air current is then produced. To this end, various methods may be employed, for example, a method in which suction means is connected to an air outlet 7 at one end of the air channel 1 while an air inlet 8 at the other end communicates with the ambient space or is connected to blower means; and a method in which the air outlet 7 communicates with the ambient space while blower means is connected to the air inlet 8. By producing a waste discharging air current extending from the air inlet 8 to the air outlet 7 in the manner described above, it is possible to pneumatically convey the waste accumulated on the bottom 2 of the air channel and discharge it through the air outlet 7 by said air current. In addition, the air outlet 7 may be provided with a waste collector bag or filter or cyclone for collecting the discharged waste.

Instead of producing an air current flowing in the air channel 1 from one end to the other, it is possible to provide an air intake (which may also serve as an opening through which waste falls into the air channel 1) at the center of the air channel and connect suction means to both ends of the air channel, thereby producing two air currents flowing from the center of the air channel to opposite ends.

In the case of producing a suction air current in the air channel 1, instead of providing an air inlet at one end of the air channel 1, it is possible to arrange shutter means 10 so that as shown in FIG. 3 A or B, the shutter members 5 of the shutter means 10, when in the prostrated position, define an air intake clearance 9 between adjacent shutter members 5. In that case, by varying the respective sizes of said clearances 9 according to their respective distances from the air outlet 7 (i.e., the end to which suction means is connected), it is possible to produce an air current whose strength is substantially uniform throughout the air channel 1.

FIGS. 4 and 5 illustrate an example in which shutter means 11 is in the form of a cover sheet 13 adapted to be taken up by a take-up shaft (or drum) 12 disposed above one end of the air channel 1. Designated at 14 is a casing surrounding the take-up space for the cover sheet 13 and 15 designates guide means for guiding opposite sides of the cover sheet. FIG. 4 illustrates the cover sheet 13 having been taken up by the take-up shaft 12 to open the top of the air channel 1, while FIG. 5 illustrates the cover sheet 13 having been withdrawn over the air channel 1, thereby closing the top of the latter. The cover sheet 13 may be in the form of a continuous flexible sheet or a number of band plates collapsibly connected together. The embodiment described with reference to FIG. 3 may incorporate this shutter means 11 using the cover sheet 13, by providing the cover sheet with an air intake.

Shutter means 16 shown in FIGS. 6 and 7 is constituted by a plurality of plate-like shutter members 18 adapted to be rotated between two positions by rotary operating shafts 17 as in the case of the shutter means 3. However, both in a first position where the shutter members are prostrated in one direction (see FIG. 6) and in a second position where they are prostrated in the other direction (see FIG. 7), they assume a continuous form to close the top of the air channel. When they are rotated from the first to the second position, they permit the waste carried thereon to fall into the air channel 1. Thus, with such shutter means 16, waste settles on the shutter members 18 closing the top of the air channel as shown in FIG. 6 and when it accumulates to a certain degree, the shutter members 18 are rotated to the second position to thereby permit the accumulated waste to fall into the air channel 1 and at the same time re-close the top of the air channel. In such condition, a waste discharging air current is produced in the air channel 1 to pneumatically convey the fallen waste in the air channel 1 and discharge the same. According to this method, it is possible to pneumatically convey waste more easily and securely than when permitting waste to fall direct onto the bottom of the air channel 1 and settle there.

It is possible to arrange said shutter means 16 so that the shutter members 18, in both the first and the second position, may close the entire region of the top of the air channel 1, while providing an air outlet 7 at one end and an air inlet 8 at the other end of the air channel 1. However, when it is desired to suck and discharge waste by suction air current, it is also possible to arrange the shutter means 18 so that when it is in the first position, it opens one end portion of the top of the air channel 1 on the side of the air outlet 7 and that when it is in the second position, it opens the other end portion thereof on the opposite side to define an air inlet 8'.

The above described method in which waste is once received on the shutter means 16 when the latter is closing the top of the air channel may also be applied to other forms of shutter means, for example, the shutter means 11 shown in FIGS. 4 and 5.

The opening and closing of the shutter means may be effected manually or mechanically. In either case, it is desirable to operatively connect the shutter members so that the actuation of a single operating shaft drives all the shutter members. Rotation drive means such as a solenoid may, of course, be provided for each shutter member. As to when to open or close the shutter means and actuate the means for producing a waste removing air current in the air channel (i.e., suction means or blower means), this may be left to the operator's judgment. Alternatively, means may be provided for detecting the time when the waste has accumulated to a predetermined degree, whereupon it emits a detection signal to provide for rational operation of waste removal. Further, a timer may be used to control the operating interval. Said detection means may comprise a light emitter and a light receiver (e.g., a photo tube or photo cell) disposed on opposite sides of the location where waste accumulates so that the light is intercepted by the waste when the latter has built up to a predetermined height.

When detecting means or timer is used as described above, the signal emitted therefrom may be used to automatically actuate the waste discharge air current producing means or the device for driving the means for opening and closing the shutter means, thereby enabling the waste removal operation to be carried out in a full automatic manner.

Shutter means shown in FIG. 8 comprises a plurality of shutter members 22 pivotally mounted on shafts 21 so as to be movable between a first position (shown in solid lines) where they close the top of the air channel 1 and a second position (shown in phantom lines) where they permit waste carried thereon to fall into said air channel 1, and balance weights 23 for upwardly urging said shutter members to maintain them in said first position until the waste builds up to a predetermined weight. The urging means may be in the form of springs or may be positioned outside the air channel and operatively connected to the shutter members through the shafts 21. Designated at 24 is a stop for stopping the endmost shutter member 22 in the first position and stoppers for the other shutter members are constituted by the end edges of adjacent shutter members. However, said stop 24 may be provided for each of the shutter members 22.

According to the shutter means 20 constructed in the manner described above, waste settles on the shutter members 22, and when it accumulates to a predetermined weight, the shutter members 22 are downwardly tilted to assume the second position against the action of the balance weights 23, so that the waste thereon automatically slides down into the air channel 1, whereupon the shutter members are automatically returned to the first position to close the top of the air channel. If, therefore, a waste discharging air current is produced at a suitable time, the waste which has fallen into the air channel can be pneumatically conveyed and discharged.

In addition, the provision of such means 20 ensures that the intended object is achieved even if a waste discharging air current is produced in the air channel 1 at all times.

In the shutter 20, it is desirable to provide for adjustment of the force of the urging means for upwardly urging the shutter means 22 to maintain the latter in the first position. For example, the balance weights 23 may be arranged so that they may be moved toward and away from the shafts 21. More desirably, in order to facilitate fine adjustment, a separate small weight 25, as shown in FIG. 9, may be associated with each weight 23 so as to be movable toward and away from the associated shaft 21. Designated at 26 is a threaded shaft over which said weight 25 is threadedly fitted.

Shutter means 27 shown in FIG. 10 comprises a plurality of shutter members 29 each pivotally mounted on a shaft 28 and associated with urging means such as a spring or weight (not shown) so that regardless of the weight of the waste accumulated on the shutter members 29, the latter are maintained in a first position where they close the top of the air channel 1. The shutter means 27 can be associated with a device for opening the shutter members 29 to a second position where they uncover the top of the air channel, said device comprising driven elements 30 each connected to one shutter member 29 through the associated shaft 28, and an operating projection 32 adapted to be moved by unillustrated drive means while being guided by a rail 31 disposed along the row of shutter members, the arrangement being such that as the operating projection 32 is moved, it successively kicks the driven elements 30 to thereby temporarily open the shutter members to the second position against the action of said urging means, thereby permitting the waste accumulated thereon to fall into the air channel 1. In this case also, a waste discharging air current may be produced in the air channel 1 at all times.

The successive shutter member opening device 33 described above has been shown installed within the air channel 1, but it is desirable to install it outside the air channel 1. The means for moving the operating projection 32 may be in the form of a wrapping connector such as a chain or rope, or it may be a screw shaft. As for the movement of the operating projection 32, there may be conceived two ways, one in which the advance and return strokes thereof follow one and the same path and the other in which they take different paths. In the former case, it is necessary to arrange the operating projection 32 so that it is prostratable only in the advance direction against the action of a spring so as not to reversely actuate the driven elements 30 in the return stroke.

Shutter means 34 shown in FIG. 11 is substantially the same as said shutter means 27 except that the position of each shaft 28 is shifted to the center of the associated shutter member 29. In this case, a smaller urging force is sufficient for holding the shutter members 29 in a first position where they cover the top of the air channel, and hence the force required for opening the shutter members 29 to a second position is small. In addition, if driven elements 30 as shown are made of a material of heavy mass and suitably shaped, they can serve as weights for holding the shutter members in the first position.

Examples in which the present invention is applied to the removal of waste in a carding machine are given below.

FIG. 12 shows an example in which a device equipped with the shutter means 16 shown in FIGS. 6 and 7 is used. In the figure, 35 designates a dish plate; 36, a feed roller; 37, a taker-in roller; 38, a mote knife; 39, a taker-in casing; 40, a cylinder; and 41 designates a cylinder casing. In this embodiment, the air channel 1 is shown disposed in such a manner that the direction of its length (i.e., the direction of flow of air current) is parallel to the direction of length of the machine (i.e., the direction of travel of the lap), but is is also possible to dispose the air channel so that said two directions cross each other at right angles. Further, a plurality of shutter means 16 may be provided for a single air channel 1 and arranged side by side in the direction of width of the air channel 1. The air channel 1 may, of course, then be partitioned into compartments, one for each shutter means.

The bottom 2 of the air channel 1 may be constituted by the floor surface under the carding machine, but if said floor surface is not sufficiently smooth, a sheet 42 may be laid as shown to serve as the bottom 2 of the air channel 1. The lateral plates of the carding machine may be used to close opposite sides of the air channel 1 or separate, air channel defining lateral plates may be used for this purpose. Designated at 43 is a suction plenum and 44, a waste guide plate.

When the carding machine is operated to carry out the usual carding operation, waste including unusable short fibers and foreign matter falls from the path of travel of the lap. The shutter means 16 described with reference to FIGS. 6 and 7 is operated to permit the waste to fall into the air channel 1 and the waste is then pneumatically conveyed by a suction air current produced in the air channel 1 by said suction plenum 43. The waste is thus discharged into the outside of the machine by the suction plenum 43. In addition, there are various methods of producing a waste discharging air current as previously described above, and a suitable one may be used. Further, the shutter means 16 has been shown by way of example only, and any of the various shutter means 3, 10, 11, 20, 27 and 34 may be used in place of the shutter means 16. For the information of the reader, an example is given in FIG. 13 in which the shutter means 11 is used. In the figure, 45 designates a guide roller for the sheet 13, and 46 designates a bar connected to the front end of the sheet 13 and having rollers at opposite ends thereof adapted to be guided by guide means 15 disposed on both sides.

In addition, in the case where waste is once permitted to accumulate on rotary shutter members and the latter are then temporarily opened to transfer the waste into the air channel, in order to facilitate the falling of the waste from the shutter members into the air channel, the shutter members may be vibrated during or after the opening thereof or the plate or sheet forming the bottom of the air channel may be temporarily charged with static electricity to attract the waste into the air channel. Further, the shutter members may be normally charged to attract the waste and discharged during or after the opening thereof to permit the waste to fall into the air channel.

In the case of applying the present invention to a carding machine, the waste removing apparatus may be installed to extend throughout the space under the machine from the space under the taker-in roller to the space under the doffer, but it is also possible to install it only in the space under the taker-in roller in which waste is predominant and whose vertical longitudinal sectional area is larger than those of the other spaces.

FIG. 14 shows an example of such installation, wherein a partition member 47 which isolates the space under the taker-in roller from the space under the cylinder 40 is vertically divided into two portions, an upper portion **47*a* which is fixed in position and a lower portion 47*b* which is pivotally mounted on a pivot shaft 48 for pivotal movement to its prostrated position under the taker-in roller, said movable shutter member 47*b* in its prostrated position serving to cover the top of the air channel 1. The air inlet 8 to the air channel 1 opens into the space under the cylinder. Designated at 49 is a stop for receiving the free end of the shutter member 47*b*** in the prostrated position.

According to the arrangement described above, with the shutter member **47*b* erected, the waste which falls from areas close to the taker-in roller 37 accumulates on the bottom 2 of the air channel 1 whose top is now opened. At a suitable time, the shutter member 47*b* is prostrated to cover the top of the air channel 1 and the suction plenum 43 is actuated, whereby the waste in the air channel 1 can be discharged by the suction air current flowing from the air inlet 8 to the air outlet 7**. That is, a large amount of waste from under the taker-in roller can be securely discharged by means of a small amount of suction air current. Moreover, there is no danger of the sucking force acting direct on the lap traveling under the taker-in roller and even good fibers being drawn out.

When the present inventive apparatus is installed under the taker-in roller, it is not limited to the use of the shutter means 50 shown in FIG. 14 and any of the various shutter means so far described may be utilized. Further, when the air inlet 8 to the air channel 1 disposed under the taker-in roller is arranged to open into the space under the cylinder and a suction air current is produced as the waste discharging air current, the effect of the sucking force will extend to the space under the cylinder and to the space under the doffer. Accordingly, the waste in these spaces can also be discharged at the same time. In order to securely obtain this effect, grid 53 having waste passage clearances 52 is installed under the cylinder as shown in FIG. 14 with a spacing maintained between it and the bottom 51 so as to define an under-cylinder air channel 54 surrounded with the grid 53, bottom 51 and opposite side walls (not shown), said air channel 54 communicating with the air inlet 8.

The grid 53 may be in the form of a plurality of band-like plates 56 extending in the direction of width of the air channel 54 between side frames 55 and disposed with their downstream ends sloping down, as shown in FIG. 15 A, or it may be in the form of a flat plate 57 installed between the side frames 55 and formed with a series of slits serving as the waste passage clearances 52, as shown in FIG. 15 B.

When the under-cylinder air channel 54 covered with the grid 53 described above is used by being connected to the air channel 1 disposed under the taker-in roller, the production of a waste discharging suction air current in the air channel 1 results in an air current being likewise produced in the under-cylinder air channel 54, with the sucking force concentratedly acting on the clearances 52 in the grid 53. Therefore, the waste which has fallen into the air channel 54 through the clearances 52 can be suction-wise discharged and also the waste which has accumulated on the grid 53 can be securely drawn into the air channel 54 and discharged together with the waste associated with the taker-in roller.

A grid 58 shown in FIG. 16 is in the form of unit plates 59 defining waste passage clearances 52 and curved so as to be upwardly convex and they are vertically swingably mounted adjacent their rear ends (i.e., upstream ends) so that they normally assume a grid forming attitude as shown in FIG. 16 by gravity. When the grid 58 constructed in the manner described above is installed, the production of a waste discharging suction air current in the air channel 54 results in the waste accumulated on the grid 52, whereupon the unit plates 59 thus relieved of their loads are upwardly urged by the air current to turn upwardly around the axes of the shafts 60 until adjacent unit plates 59 become continuous to close the clearances 52, as shown in FIG. 17. Therefore, a smaller amount of air current is sufficient for pneumatic conveyance and discharge of waste in a reliable manner.

The under-cylinder air channel 54 covered with such grid 53 or 58 may be extended to the space under the doffer so as to serve for effective removal of the waste coming from areas close to the doffer. Particularly, the self-closable type grid 58 formed of unit plates 59 is usable as shutter means for closing the top of the air channel 1 according to the present invention.

Figure 18:
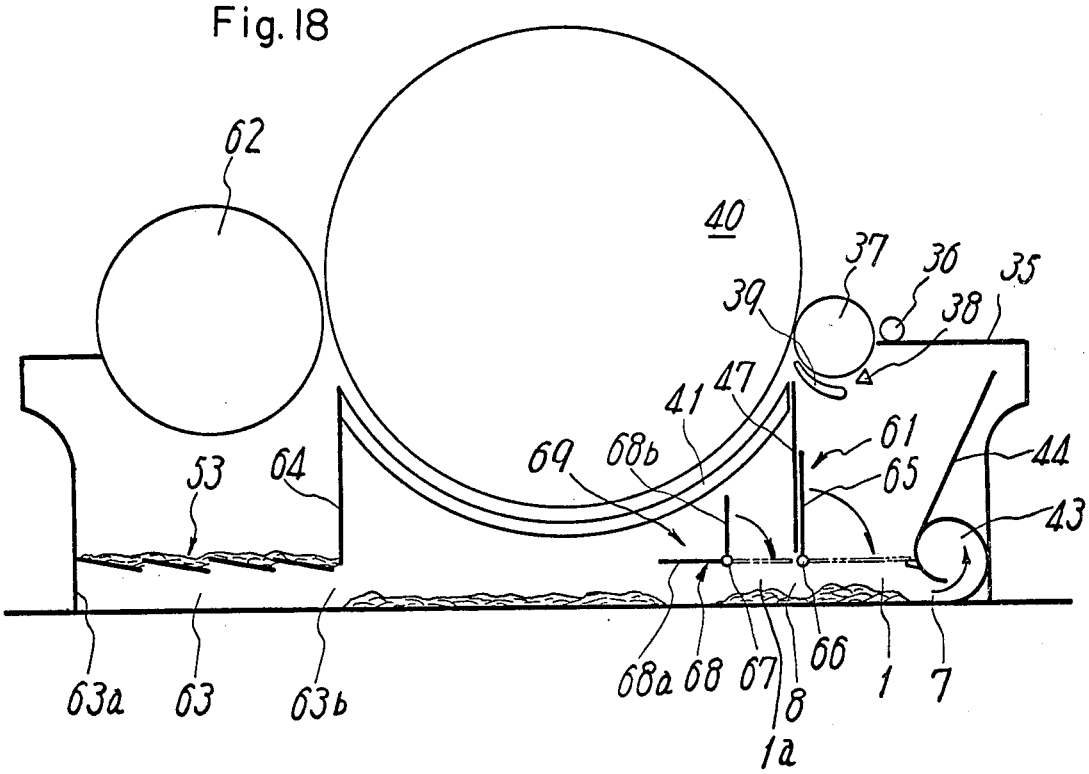

An embodiment shown in FIG. 18 comprises an air channel 1 adapted to be opened and closed by shutter means 61 and disposed under the taker-in roller 37, the air outlet 7 from said air channel 1 being connected to a suction plenum 43, the air inlet 8 to said air channel being disposed to open into the space under the cylinder 40, an under-doffer air channel 63 covered with the grid 53 (or the grid 58 shown in FIG. 16) and disposed under the doffer 62, one end **63*a* of said air channel 63 being closed and the other end having an opening 63*b* communicating with the space under the cylinder, and partition members 47 and 64 for isolating the space under the taker-in roller 37, the space under the cylinder 40 and the space under the doffer 62 from each other. Whereas the shutter means 50 shown in FIG. 14 has its shutter member 47*b* constituted by making use part of the partition member 47, the shutter means 61 shown in FIG. 18 comprises a shutter member 65 separate from the partition plate 47 and pivotally mounted on a shaft 66. However, this is no different therefrom in that the shutter member 65 is turned around the axis of the shaft 66 until it is prostrated when the top of the air channel 1** is to be closed.

As shown in FIG. 18, the entire space under the cylinder the vertical longitudinal sectional area of which space is relatively small, may be used as a waste discharging air channel and the air channel 63 covered with the grid 53 may be provided only in the space under the doffer 62. It is of course possible to install in the space under the doffer the air channel 1 provided with any of the various shutter means described above.

Even in the case of using the entire space under the cylinder as a waste discharging air channel, since that portion of the air channel 1 under the taker-in roller which opens as wide as compared with the portion immediately below the central region of the cylinder, it is possible to provide an under-cylinder partial air channel **1*a* whose bottom and opposite sides are closed and which is installed only in that part of the space under the cylinder which is adjacent to the free end opening, i.e., air inlet 8 of the above-mentioned air channel 1 under the taker-in roller, said under-cylinder partial air channel 1*a* communicating at its one end with said air channel 1 under the taker-in roller and at the other end with the remaining portion of the space under the cylinder, the top thereof being provided with shutter means 69 adapted to be switched between an open position where it permits entry of waste into said partial air channel 1*a* and a closed position where it cuts off communication between the inside and outside of said partial air channel. Such shutter means 69 may be replaced by any suitable one of the various forms of shutter means so far described. For example, one or several shutter members 68 pivotally supported at shafts 67 may be provided at a position suitably spaced apart from the air inlet 8 to the air channel 1. The shutter members 68 may be arranged so that they are prostrated as shown at 68*a* or erected as shown at 68*b* except during waste drawing and discharging operation. In the former case, it is possible to cause the waste accumulated on the shutter members 68 to fall into the air channel 1*a* by rotating the shutter members through about 180°, while the latter case permits a relatively large amount of waste to fall onto the bottom of the space under the cylinder. In waste drawing and discharging operation, the shutter members 68 are rotated through 180° or 90° so that the shutter members 68 now prostrated as shown in phantom lines close the top of the air channel 1*a*, form an extension of the air channel 1 under the taker-in roller and make it difficult for the sucking force to act on the space above the shutter members 68**.

Figure 19:
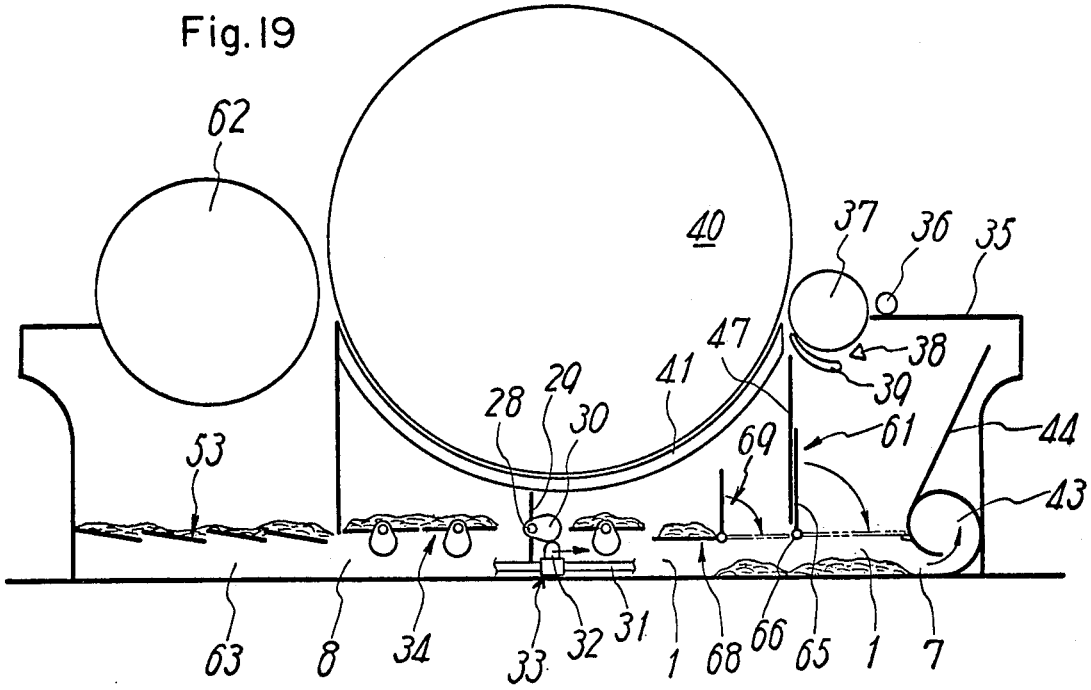

In addition, when the space under the cylinder is relatively wide as measured in the vertical direction, besides the arrangement shown in FIG. 18 it is possible to install an air channel 1, as shown in FIG. 19, provided with suitable shutter means (in the illustrated example, the shutter means 34 shown in FIG. 11 is used). In this case, the air channel 1 installed under the taker-in roller and with the air channel 63 installed under the doffer. Further, it also belongs to the technical scope of the present invention to provide an arrangement in which an air channel whose top is opened and closed by shutter means according to the present invention is installed to extend from the space under the taker-in roller to the space under the cylinder, and with no such installation under the doffer, the air inlet to said air channel is permitted simply to open into the space under the doffer.

Figure 20:
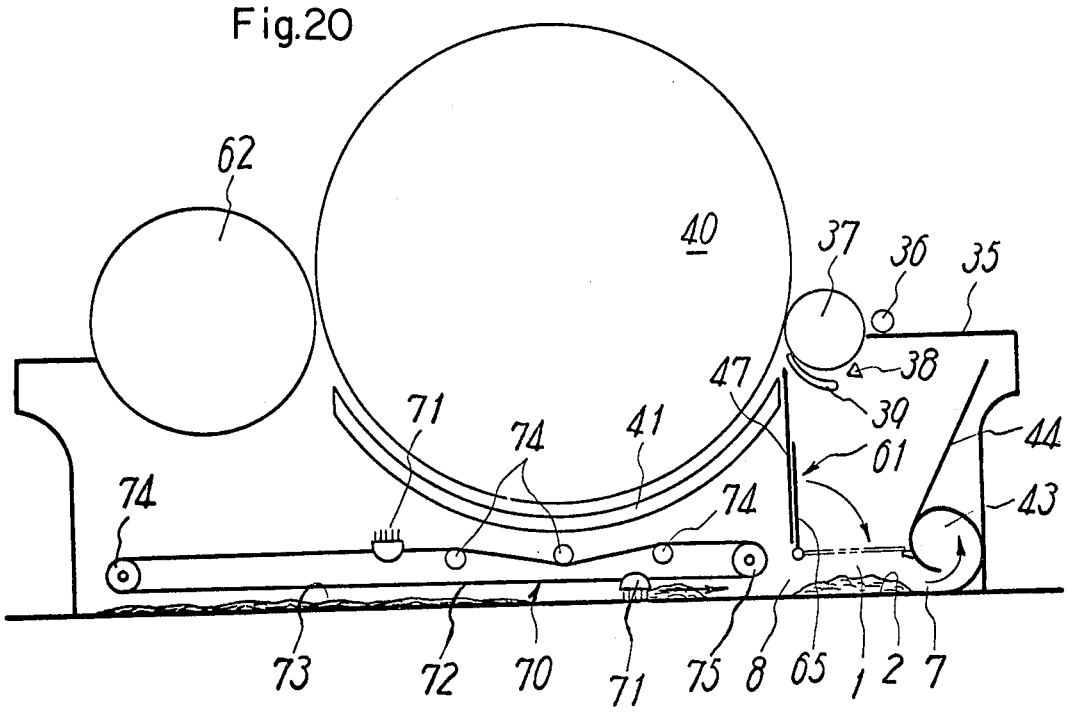

In an embodiment shown in FIG. 20, in place of the grid 53 used in the embodiment shown in FIG. 14, there is provided means 70 for sweeping at least the under-cylinder waste to move it an area close to the air inlet 8 to the air channel under the taker-in roller. There may be various forms of said means 70 conceivable, but the one used in this embodiment comprises an endless chain (or the like) 72 equipped with waste sweeping brushes 71 and entrained around a plurality of guide wheels 74 and a drive wheel 75 in such a manner that in the advance stroke of the brushes 71 toward the air inlet 8 to the air channel 1, they are moved in contact with a waste accumulation bottom 73.

According to the above arrangement, the chain 72 is driven by the drive wheel 75 when or at a suitable time before a waste discharging and drawing air current is produced in the air channel, whereby the waste accumulated on the bottom 73 of the space under the doffer and cylinder is swept together and moved to an area close to the air inlet 8 to the air channel 1. Therefore, a smaller amount of suction air current is sufficient for securely drawing and discharging all the waste under the machine.

Figure 21:
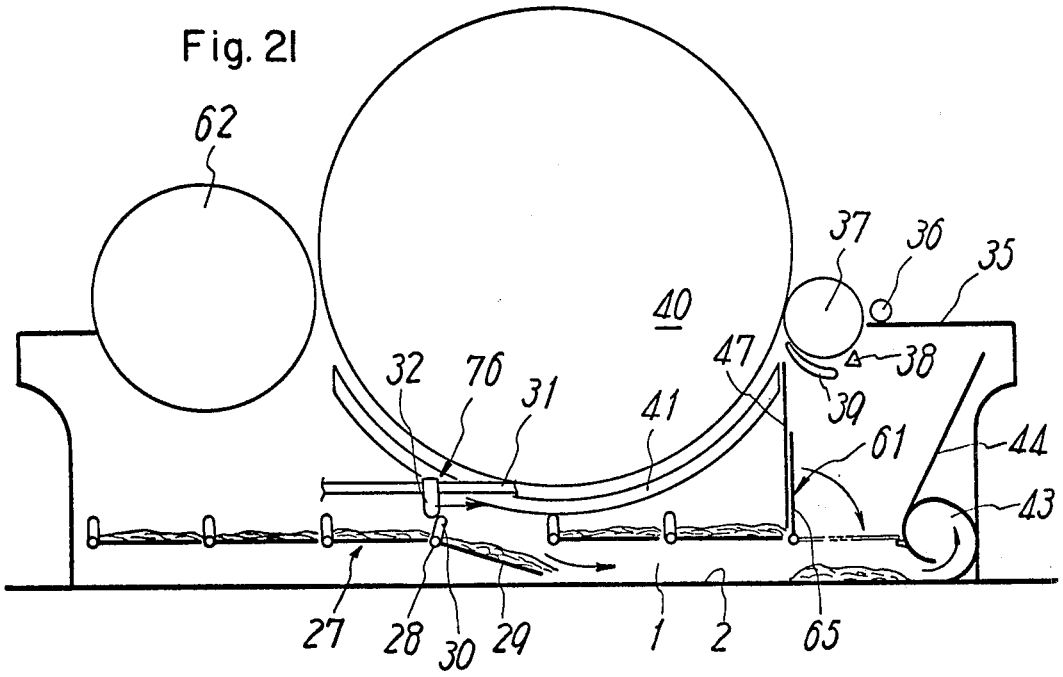

As is clear also from the embodiment shown in FIG. 19, when an air channel 1 provided with openable and closable shutter means is to be installed under a carding machine, there is no need to provide one and the same shutter means throughout the length of the air channel 1. That is, the construction of such shutter means may be changed depending upon the vertically measured wideness of the space and other conditions. FIG. 21 shows an example in which when an air channel 1 equipped with openable and closable shutter means is to be installed to extend throughout the space under the machine, said space is divided into two regions, one under the taker-in roller and the other under the cylinder and doffer, and two different shutter means (in the figure, the shutter means 27 and 61 are used) are provided therefor. A successive shutter opening device associated with the shutter means 27 under the cylinder and doffer shown in the figure is substantially the same as the successive shutter member opening device 33 associated with the shutter means 27 shown in FIG. 10 except that driven elements 30 project upwardly from shafts 28, as a result of which the direction in which an operating projection 32 kicks the driven elements to open the shutter members 29 is reversed from that shown in FIG. 10.

Figure 22:
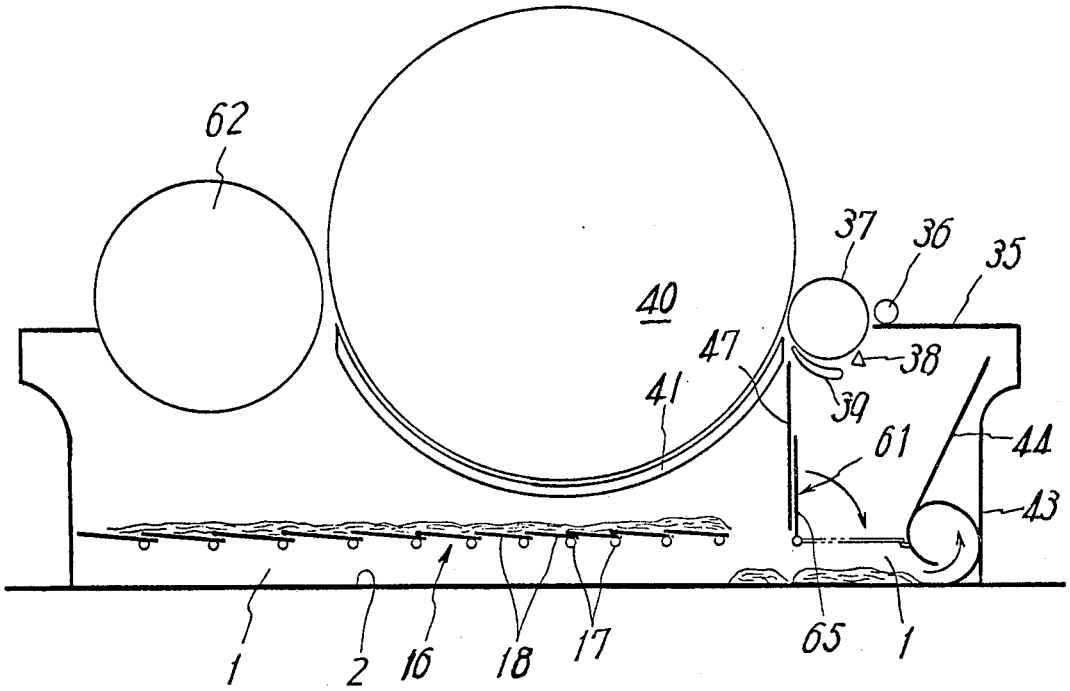

FIG. 22 shows a modification of the embodiment shown in FIG. 21, wherein the shutter means 16 shown in FIG. 21 is replaced by the shutter means 16 shown in FIG. 6. In place of the shutter means 16, it is of course possible to use other shutter means.

Further, it is possible to provide different constructions of shutter means for the spaces under the taker-in roller, cylinder and doffer. It is also possible to change only the construction of shutter means under doffer.

I claim:

1. Apparatus for removing waste from under a carding machine installed on a supporting surface, said machine including a taker-in roller, a cylinder having a casing, and a doffer, wherein the improvement comprises:

shutter means placed above said supporting surface in a region at least below said taker-in roller, said shutter means comprising a cover sheet;

suction means for removing waste from below said shutter means, said suction means including an air channel and said shutter means forming the top of said air channel in said region; and, means for retracting said cover sheet from said air channel to an open position in which waste is permitted to fall into said air channel and for drawing said cover sheet over said air channel to a closed position in which the shutter means forms the top of said air channel.

2. A method of removing waste from a surface on which a carding machine is supported, comprising providing on said surface in a region where waste accumulates an air channel whose bottom and opposite sides are closed and whose top is openable and closable, opening said top and permitting waste to accumulate in said air channel, closing said top, and producing a waste-discharging air current in said air channel whose top is closed thereby pneumatically conveying the waste accumulated in the air channel for discharge.

3. Apparatus for removing waste from under a carding machine installed on a supporting surface, said machine including a taker-in roller, a cylinder having a casing, and a doffer, wherein the improvement comprises:

an air channel extending across said supporting surface, said air channel having a first portion located below the taker-in roller, and a second portion extending from the first portion and located below at least a part of the cylinder, said second portion terminating in an inlet opening;

partition means for separating the space above said first air channel portion from the space above said second air channel portion;

shutter means forming at least a part of the top of said air channel, said shutter means including a first plate-like shutter member for said first air channel portion and a second plate-like shutter member for said second air channel portion;

means mounting said shutter means for movement between an open position in which waste is permitted to fall into and collect in said air channel and a closed position in which the top of said air channel formed by said shutter means is enclosed, said mounting means rotatably supporting said first and second shutter members for substantially 90° of movement between said open and closed positions, said second shutter member being arranged to close the top of the second air channel portion adjacent to said partition means; and, suction means for drawing air into the enclosed air channel through said inlet opening whereby waste collected in the air channel is removed.

4. Apparatus as set forth in claim 3 wherein said first shutter member in the open position forms part of said partition means.

5. Apparatus as set forth in claim 3 wherein said second portion of the air channel extends under the doffer.

6. Apparatus as set forth in claim 5 wherein a grid having waste passages therein forms the top of said under-doffer air channel portion.

7. Apparatus as set forth in claim 5 including a partition member separating the space above said second portion of the air channel into an under-doffer portion and an under-cylinder portion.

8. Apparatus as set forth in claim 5 wherein said mounting means pivotally supports one end of said first shutter member at a location adjacent to said second portion of the air channel.

9. Apparatus for removing waste from under a carding machine installed on a supporting surface, said machine including a taker-in roller, a cylinder having a casing, and a doffer, wherein the improvement comprises:

an air channel extending across said supporting surface, said air channel having a first portion located below the taker-in roller, and a second portion extending from the first portion and located below at least a part of the cylinder, said second portion terminating in an inlet opening:

shutter means forming at least a part of the top of said air channel, and a grid having waste passages thereon forming the top of at least part of said second air channel portion;

means mounting said shutter means for movement between an open position in which waste is permitted to fall into and collect in said air channel and a closed position in which the top of the air channel is formed by shutter means is enclosed; and, suction means for drawing air into the enclosed air channel through said inlet opening whereby waste collected in the air channel is removed.

10. Apparatus as set forth in claim 9 wherein said grid is provided with a plurality of plates forming said waste passages, said plates being pivotally mounted and arranged so as to be pivotally urged by said suction means in a direction such as to close said waste passages.

11. Apparatus for removing waste from under a carding machine installed on a supporting surface, said machine including a taker-in roller, a cylinder having a casing, and a doffer, wherein the improvement comprises:

an air channel extending across said supporting surface, said air channel having a first portion located below the taker-in roller, and a second portion extending from the first portion and located below at least a part of the cylinder, said second portion terminating in an inlet opening;

partition means for separating the space above the first air channel portion from the space above said second air channel portion;

shutter means forming at least a part of the top of said air channel, said shutter means including a single plate-like shutter member for said first air channel portion;

means mounting said shutter means for movement between an open position in which waste is permitted to fall into and collect in said air channel and a closed position in which the top of the air channel formed by said shutter means is enclosed, said mounting means rotatably supporting said shutter member for substantially 90° of movement between said open and closed positions, said shutter member in the open position forming part of said partition means; and, suction means for drawing air into the enclosed air channel through said inlet opening whereby waste collected in the air channel is removed.

* * * * *

UNITED STATES PATENT AND TRADEMARK OFFICE

CERTIFICATE OF CORRECTION

PATENT NO. : 4,087,888

DATED : May 9, 1978

INVENTOR(S) : Toyozo Tanaka

It is certified that error appears in the above-identified patent and that said Letters Patent are hereby corrected as shown below:

Column 3, line 11, change "15" to read --16--;

Column 9, line 23, change "grid 52" to read --grid 58 being drawn into the air channel 54 through the clearances 52--;

Column 11, line 6, after the words "air channel" insert the number --1--.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*